US012698110B2

(12) United States Patent
Lespinasse et al.

(10) Patent No.: US 12,698,110 B2
(45) Date of Patent: Aug. 4, 2026

(54) PRODUCT PACKAGING MACHINE AND METHOD

(71) Applicant: Ranpak Corp., Concord Township, OH (US)

(72) Inventors: Bruno Lespinasse, Turku (FI); Henri Hiisilä, Forssa (FI)

(73) Assignee: Ranpak Corp., Concord Township, OH (US)

( * ) Notice: Subject to any disclaimer, the term of this patent is extended or adjusted under 35 U.S.C. 154(b) by 0 days.

(21) Appl. No.: 18/862,070

(22) PCT Filed: Apr. 27, 2023

(86) PCT No.: PCT/US2023/020100
§ 371 (c)(1),
(2) Date: Oct. 31, 2024

(87) PCT Pub. No.: WO2023/215159
PCT Pub. Date: Nov. 9, 2023

(65) Prior Publication Data

US 2025/0178764 A1 Jun. 5, 2025

Related U.S. Application Data

(60) Provisional application No. 63/337,598, filed on May 2, 2022.

(51) Int. Cl.
*B65B 11/50* (2006.01)
*B65B 9/02* (2006.01)
(Continued)

(52) U.S. Cl.
CPC ..... *B65B 11/50* (2013.01); *B65B 9/02* (2013.01); *B65B 51/02* (2013.01); *B65B 61/06* (2013.01)

(58) Field of Classification Search
CPC ..... B65B 11/50; B65B 5/02; B65B 51/02; B65B 51/06; B65B 59/001; B65B 61/06; B65B 9/02
See application file for complete search history.

(56) References Cited

U.S. PATENT DOCUMENTS 2,998,337 A * 8/1961 Tillotson ..... E04B 1/80 52/406.1
3,750,361 A 8/1973 Stevens
(Continued)

FOREIGN PATENT DOCUMENTS

DE 102020123361 A1 * 3/2022 ..... B65D 71/06
JP 2022000397 A 1/2022

OTHER PUBLICATIONS

A machine translation of DE 10 2020 123361 A1 (Year: 2022).*
International Search Report and Written Opinion mailed Oct. 2, 2023, for International Application No. PCT/US2023/020100.

*Primary Examiner* — Himchan Song
(74) *Attorney, Agent, or Firm* — Renner, Otto, Boisselle & Sklar, LLP

(57) ABSTRACT

A method for wrapping a product for shipment includes advancing a base layer in a downstream direction and placing a product for wrapping on the base layer. After the product is placed on the base layer, an adhesive is deposited onto the base layer at a location adjacent the product. A cover layer is then applied over the top of the product and the base layer. The cover layer is secured to the base layer via the adhesive, and the product is secured to the base layer by the cover layer being secured to the base layer both upstream and downstream of the product. The base layer is then transversely folded over both the cover layer and the product to securely wrap the product for shipment.

17 Claims, 10 Drawing Sheets

(51) Int. Cl.
*B65B 51/02* (2006.01)
*B65B 61/06* (2006.01)

(56) References Cited

U.S. PATENT DOCUMENTS

| | | | | |
|---|---|---|---|---|
| 4,594,835 | A * | 6/1986 | Gray | A61F 15/001 53/436 |
| 6,403,208 | B1 * | 6/2002 | Otaki | F16L 59/04 428/297.4 |
| 6,972,144 | B2 * | 12/2005 | Roth | B29C 70/50 428/68 |
| 8,910,438 | B1 * | 12/2014 | Shiban | E04H 9/14 52/DIG. 9 |
| 10,287,048 | B2 | 5/2019 | Sytema et al. | |
| 2018/0064118 | A1 * | 3/2018 | Bolla | A21C 11/10 |
| 2019/0039765 | A1 * | 2/2019 | Mallya | C09J 5/00 |
| 2020/0207500 | A1 * | 7/2020 | Kalinowski | B65B 9/06 |
| 2021/0171226 | A1 | 6/2021 | Campbell | |
| 2023/0373672 | A1 * | 11/2023 | Blezard | B31D 5/0004 |

* cited by examiner

PRODUCT PACKAGING MACHINE AND METHOD

This application is a national phase of International Application No. PCT/US2023/020100, filed Apr. 27, 2023, which claims priority to U.S. Application No. 63/337,598, filed May 2, 2022, each of which is hereby incorporated herein by reference in its entirety.

FIELD OF THE INVENTION

The present disclosure relates to a product packaging system, and more particularly, to machines and methods for wrapping a product in protective packaging material for shipment.

BACKGROUND

When shipping a product from one location to another, the product is generally shipped in a container with a protective packaging material. The container may be a cardboard box or a protective envelope. Alternatively, the product may be wrapped in a protective packaging material, such as a plastic bubble wrap, cardboard, paper, or an expanded slit sheet material, or inserted into an already-formed envelope, which is then closed to seal the product inside.

Alternatively, the product may be placed on a continuous sheet, and the lateral edges may then be guided to surround the product to form a tube in which the product can be sealed. The tube of material can then be cut to separate the enclosed product in the tube from the continuous sheet and the ends of the tube sealed. If the sheet is a plastic material, heat may be applied to "shrink" the material to more closely adhere to the shape of the product so that the product does not move relative to the material during shipment.

SUMMARY

The present disclosure relates to a system and method of wrapping products of varying sizes in layers of a protective sheet material. A product scanner scans the products to identify the size of the products and adjust the system and method for products having varying sizes. Rather than turning the lateral edges of a continuous sheet around the product, the product is placed on a continuous base layer and a continuous cover layer is drawn over both the product and base layer. The cover layer is secured to the base layer and cut, and the first layer is cut and folded around the product to complete the package. Thus, the product is secured within the layers of material so that the product does not move relative to the sheet material during shipping. The sheet material preferably is paper, which is a recyclable, reusable, and renewable resource.

The method for wrapping a product for shipment includes placing a product for wrapping on the base layer. After the product is placed on the base layer, an adhesive is deposited onto the base layer at a location upstream of the product. A cover layer is extended over the top of the product and the base layer. The cover layer is secured to the base layer upstream and downstream of the product, thereby securing the product to the base layer by the cover layer. The base layer is then folded over both the cover layer and the product.

An exemplary method for wrapping a product for shipment includes placing a product on a base layer, extending a cover layer lengthwise on top of the product, securing the cover layer to the base layer so that the product is secured to the base layer by the cover layer, and folding lateral portions of the base layer around the product widthwise and affixing the lateral portions of the base layer together after the securing step.

Exemplary embodiments of the method further include one or more of the following steps.

- cutting the base layer and the cover layer after the securing step;
- cutting the base layer and the cover layer at the same time the cover layer is secured to the base layer;
- providing the base layer from a continuous sheet stock material and providing the cover layer from a continuous sheet stock material; and
- detecting an upstream end of the product on the base layer.

The cutting step may include cutting both the base layer and the cover layer in the same cutting action, cutting the base layer and the cover layer at a location upstream of the product, cutting the base layer and the cover layer along a cut line, the cut line being disposed on the base layer with adhesive upstream and downstream of the cut line so that portions of the base layer and the cover layer are secured together on opposite sides of the cut line, cutting the base layer and the cover layer upstream of the product.

The securing step may include applying an adhesive to the base layer upstream of the product.

The securing step may include applying an adhesive to the base layer and then pressing the cover layer against the adhesive on the base layer.

The applying step may include identifying an upstream end of the product and applying the adhesive to the base layer at a location upstream of the product.

The detecting step includes detecting a length dimension of the product.

The method may include repeating the method steps for a sequence of products having at least one varying dimension.

An exemplary packaging system for wrapping a product for shipment includes a product delivery assembly configured to place a product on a base layer, a sensor for detecting an upstream end of the product on the base layer, an adhesive applicator configured to deposit an adhesive to the base layer at a location upstream of the product based on a signal from the sensor, a stock material feed assembly configured to apply a cover layer on top of the product and the base layer, and a pressing element configured to press the cover layer to the base layer so that the adhesive secures the cover layer to the base layer in such a manner that the product is secured to the base layer by the cover layer.

Exemplary embodiments of the system further include one or more of the following elements:

- a supply of sheet stock material for the base layer and the cover layer;
- a cutting assembly configured to cut across a width dimension of the base layer and the cover layer;
- a folding assembly downstream of the pressing element configured to fold lateral portions of the base layer widthwise around the product and the cover layer;
- an adhesive applicator positioned to apply adhesive to the base layer to secure the folded lateral portions together; and
- a conveyor for advancing the base layer and the product placed on the base layer in a downstream direction past the pressing element.

Another exemplary method for wrapping a product includes the steps of: (1) supplying sheet stock material for a base layer and for a cover layer; (2) advancing the base layer and the cover layer in a downstream direction; (3)

placing a product on the base layer; (4) extending a cover layer lengthwise over the product and the base layer; (5) securing the cover layer to the base layer upstream and downstream of the product so that the product is secured to the base layer by the cover layer; (6) cutting the cover layer and the base layer to separate the cover layer secured to the base layer from the supply; (7) transversely folding the base layer widthwise over the cover layer and the product; and (8) securing the transversely folded base layer in place over the cover layer and the product.

DETAILED DESCRIPTION

Figure 1:
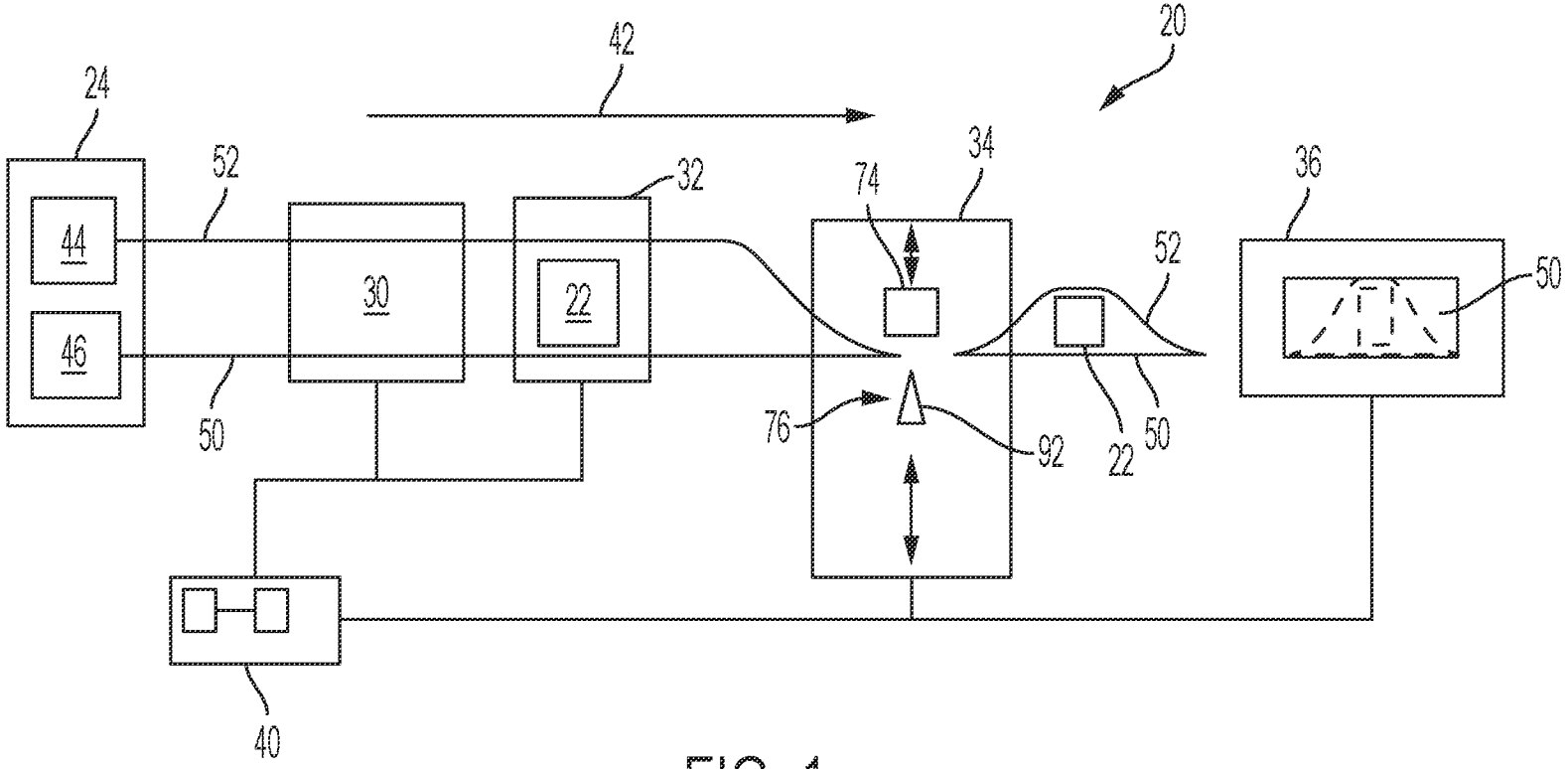
FIG. 1 is a schematic view of a product packaging system for wrapping products for shipment.
Figure 2:
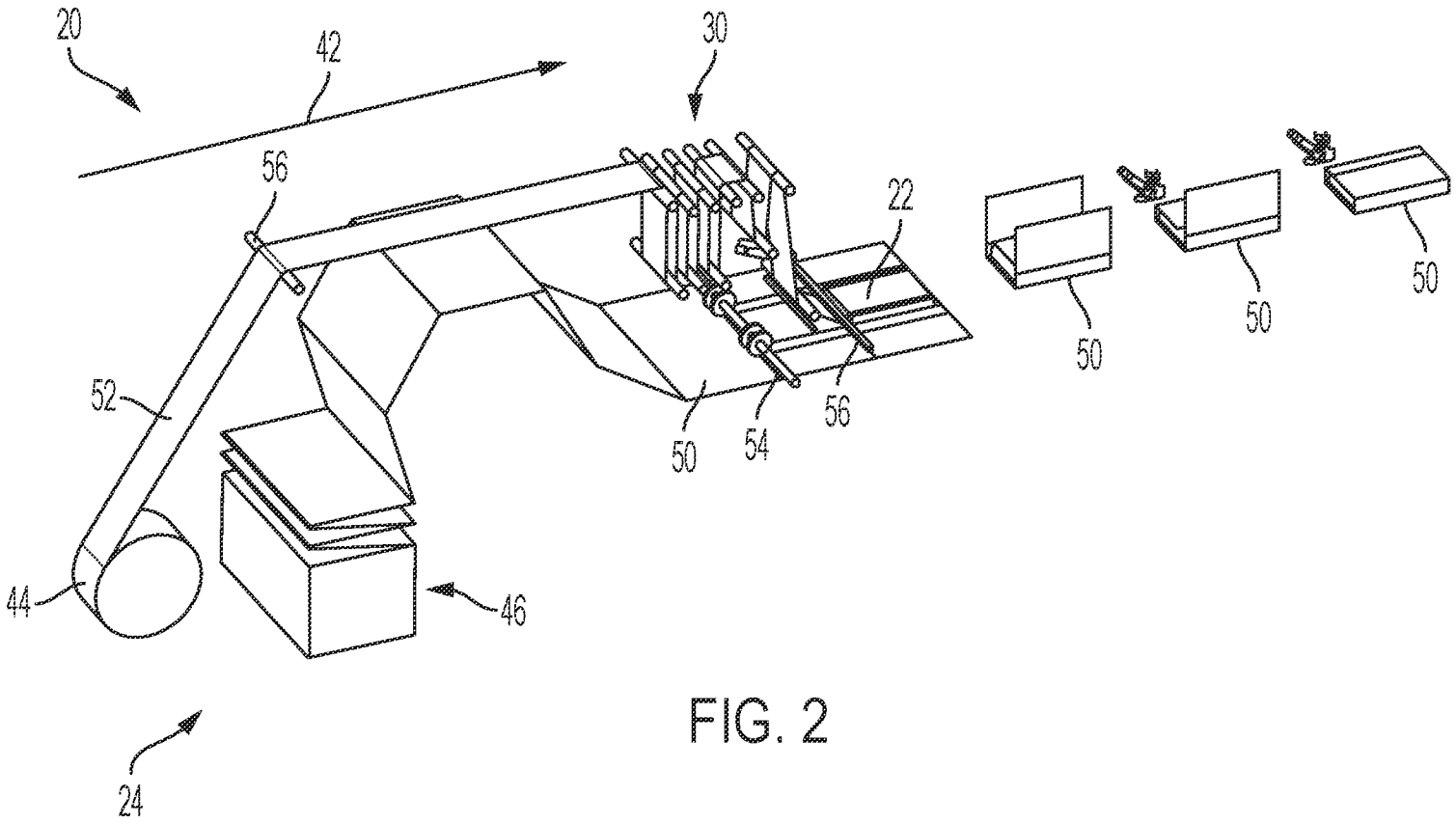
FIG. 2 is a schematic perspective view of an exemplary product packaging system for wrapping products for shipment in accordance with a first embodiment.

Referring to FIGS. 1 and 2, a packaging system 20 for wrapping one or more products 22 for shipment includes a supply 24 of sheet stock material, a stock material feed assembly 30, a product delivery assembly 32, a cutting and securing assembly 34, a folding assembly 36, and a system controller 40. The system controller 42 includes a processor, such as a programmable logic controller (PLC), a memory, and one or more inputs and one or more outputs, and is configured to control various operations of the packaging system 20. The packaging system 20 moves sheet stock material from the supply 24 in an upstream-to-downstream direction, also referred to as a downstream direction 42. The upstream direction is opposite the downstream direction 42.

The supply 24 of sheet stock material may include a support for a roll 44 of sheet stock material or a support for a fan-folded stack 46 of sheet stock material or a combination thereof, as shown in FIG. 2. The supply may include a single material, or multiple materials. In the illustrated embodiment, the supply 24 of sheet stock material includes a supply of a base material for a base layer 50 and a supply of a cover material for a cover layer 52. An exemplary sheet stock material for either the base layer 50 or the cover layer 52 or both is made of paper, such as kraft paper. Paper is an environmentally responsible choice for the sheet stock material because paper is biodegradable, recyclable, and composed of a renewable resource.

The base layer 50 and the cover layer 52 may be provided from respective continuous sheet materials. Both the base layer 50 and the cover layer 52 may be any sheet stock material that may be used to cover and protect the product 22 during transportation. In an exemplary embodiment, the base layer 50 is cardboard, a multi-layer paper product that provides some cushioning and puncture resistance, and the cover layer 52 is a single sheet of paper that is flexible enough to closely follow the shape of the product 22 being shipped but strong enough to hold the product 22 to the base layer 50. In another embodiment, both the base layer and the cover layer are made of cardboard, such as a heavier weight cardboard for the base layer and a lighter weight cardboard for the cover layer. In yet another embodiment, both the base layer and the cover layer are discrete sheets of paper of the same or different basis weights. Alternatively, the base layer and the cover layer may be any other material that protects the product during transportation and can include, but is not limited to, cardboard, paper, polyurethane, a polymer foam, cork, etc. The base layer, the cover layer, or both, may have a solid configuration. Alternatively, the base layer, the cover layer, or both may have a perforated configuration. In yet another embodiment, the base layer, the cover layer, or both may be formed of a mesh or web-like material.

The stock material feed assembly 30 advances sheet stock material in the downstream direction 42 from the supply 24 to the product delivery assembly 32. As shown in FIG. 2, the illustrated stock material feed assembly 30 includes at least one pair of powered feed rollers 54 and one or more unpowered guide members 56 that define the respective paths of the sheet stock material for the base layer 50 and the cover layer 52. The feed rollers 54 and guide members 56 of the stock material feed assembly 30 advance both the base layer 50 and the cover layer 52 in the downstream direction 42 from the supply 24 to the product delivery assembly 32.

As the stock material feed assembly 30 advances the base layer in the downstream direction 42, the product delivery assembly 32 places a product to be shipped onto the base layer 50, and the product 22 then advances through the packaging system 20 in the downstream direction 42 on the base layer 50. The product delivery system 32 typically includes a conveyor 60 to support and advance the product 22 and the base layer 50.

Figure 3:
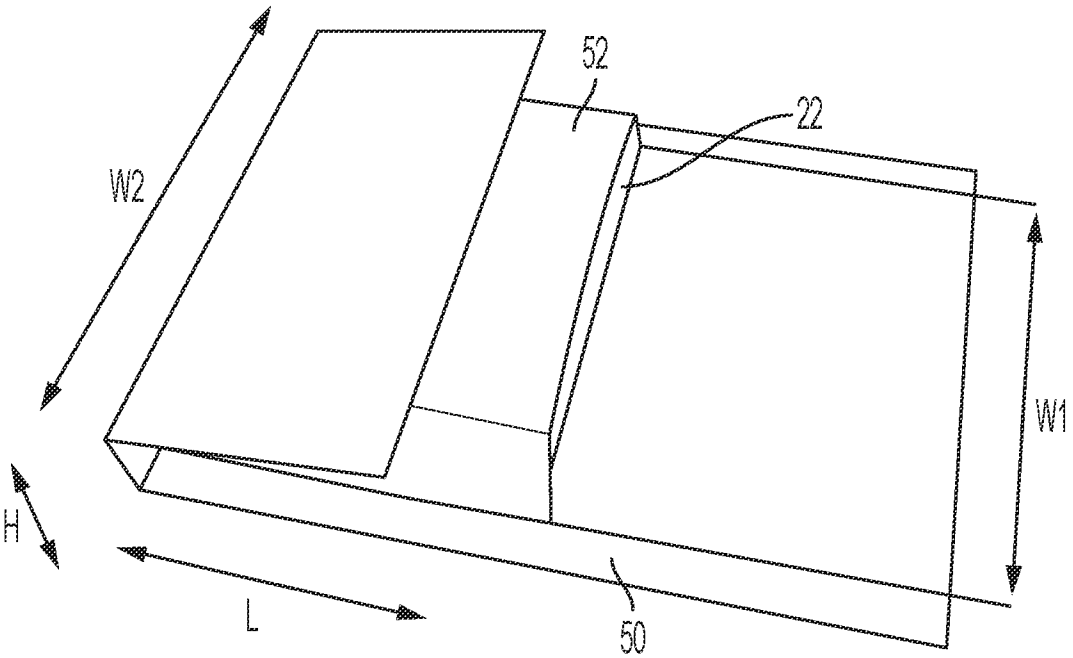
FIG. 3 is a perspective view of a package having a base layer that is partially folded.

With reference to FIG. 3, the product has a length dimension L that is parallel to the downstream direction 42, a width dimension W1 perpendicular to the length dimension L and parallel to a width dimension W2 of the base layer 50, and a height dimension H that extends in a direction perpendicular to the width dimension W1 and the length dimension L. Corresponding length and height dimensions of the wrapped product are similar to the length and height dimensions of the product. But the width dimension W2 of the base layer 50 generally is larger than the corresponding width dimension W1 of the product 22 so that the base layer 50 extends beyond at least one edge of the product 22 to provide stand-off protection for the product 22. The difference between the width dimension W1 of the product 22 and the width dimension W2 of the base layer 50, and thus the amount of the width dimension W2 of the base layer 50 that provides such stand-off protection, will vary depending on the width dimension W1 of the product 22.

Figure 11:
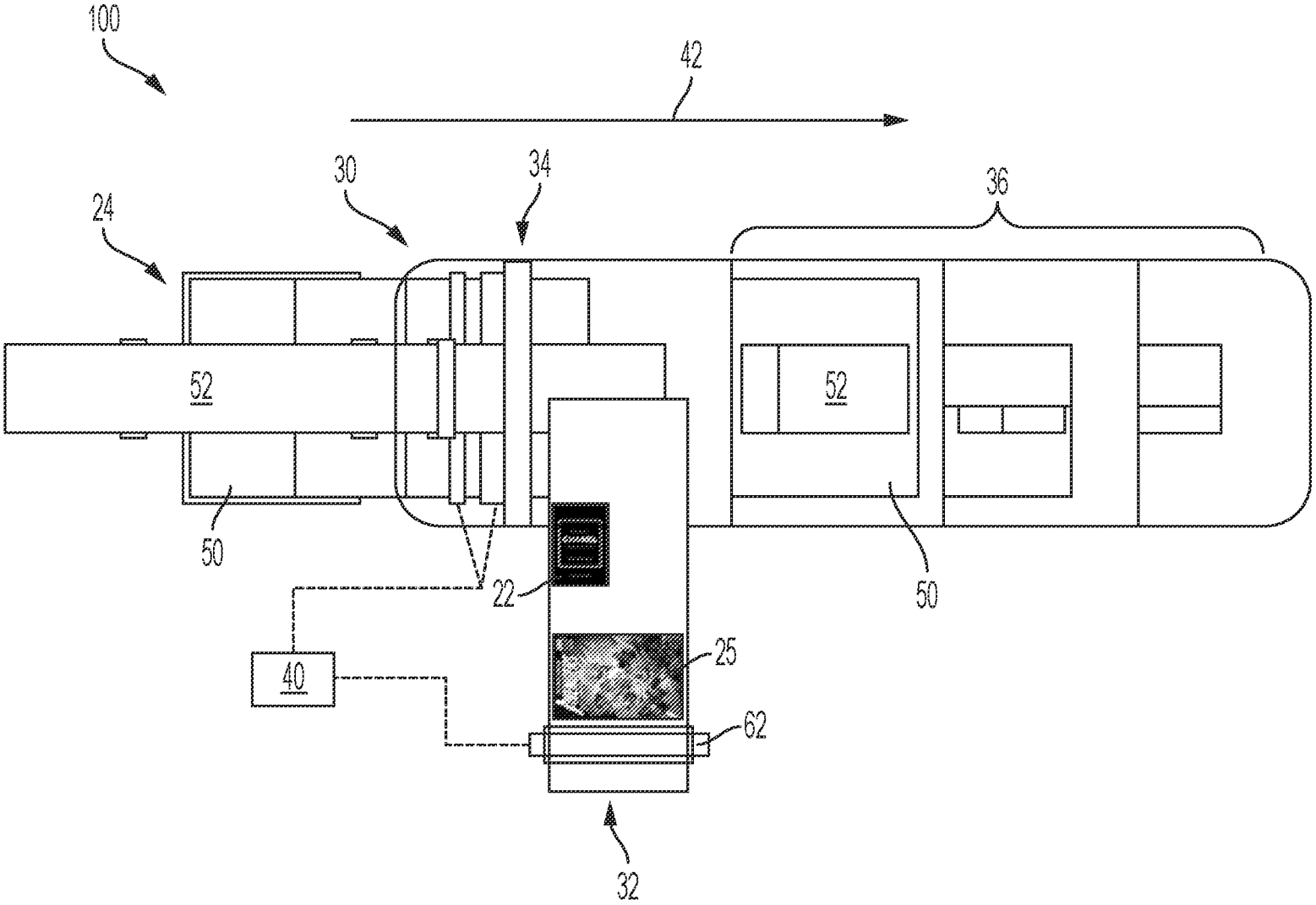
FIG. 11 is a schematic top view of another embodiment of a product packaging system.

Referring briefly to FIG. 11, the product delivery assembly 32 optionally may include a product scanner 62 that is configured to identify the size of the product 22. The product scanner 62 includes at least one sensor to determine the length dimension L of the product 22. The product scanner 62 identifies or measures the length dimension L of the product 22. The sensor may include a bar code scanner, a laser, a camera, or other device for determining one or more dimensions of the product, including at least the length dimension. Additionally or alternatively, a sensor may be provided to detect an upstream edge of the product after the product 22 is placed on the base layer 50.

The system controller 40 processes the sensor signal and outputs a signal to the cutting and securing assembly 34 and the folding assembly 36 to adjust to the determined size of the product 22. The adjustments allow the packaging system 20 to accommodate and wrap products of random sizes and shapes. Thus, a large range of product sizes and shapes can be wrapped for shipment using the same operation of the packaging system 20, as will be apparent from this disclosure.

Figure 4:
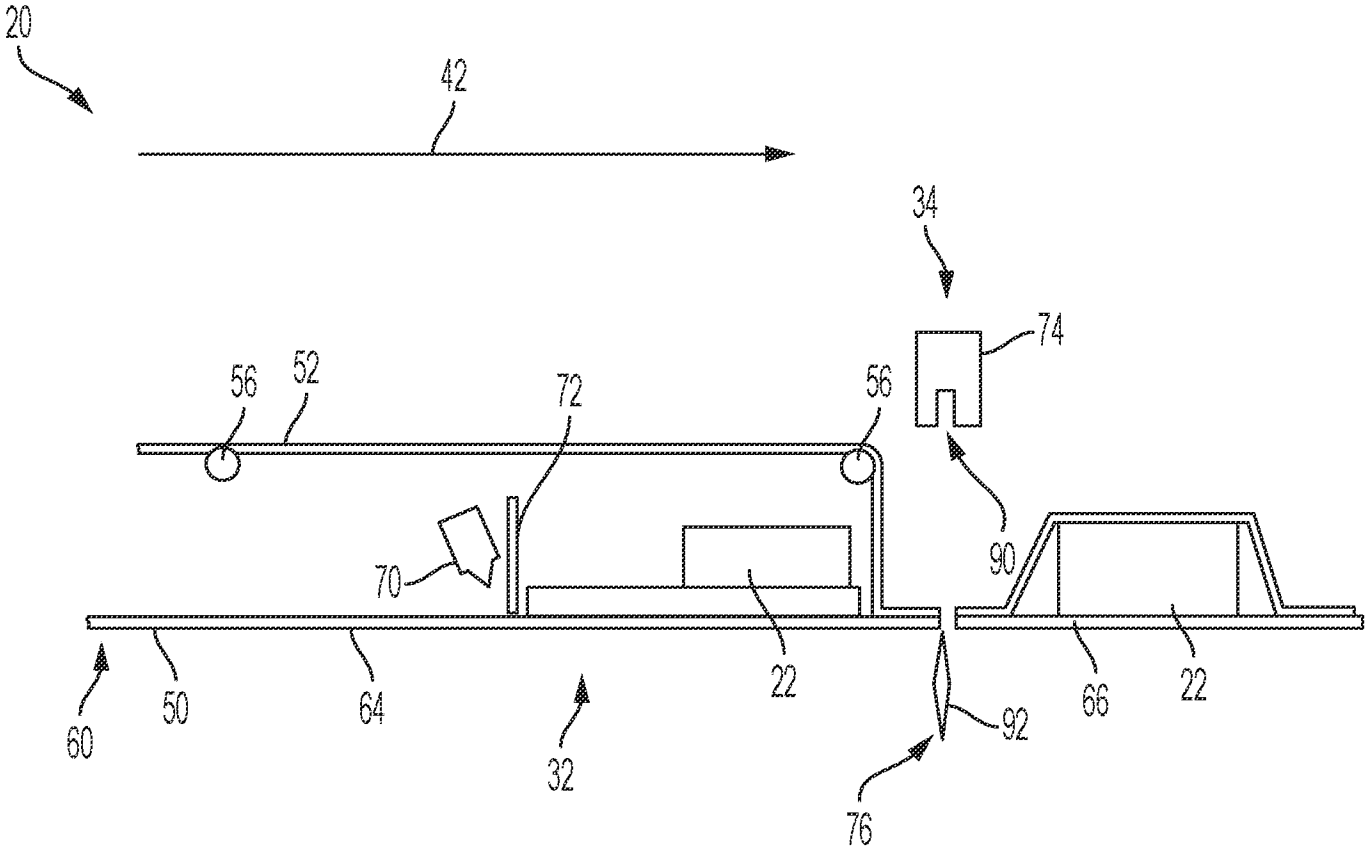
FIGS. 4-7 are schematic side views of the machine of FIG. 2 depicting sequential operations of the wrapping process.

Referring now to FIGS. 4-7, and returning to the product delivery system 32, the conveyor 60 includes a first conveyor portion 64 and a second conveyor portion 66 downstream of the first conveyor portion 64. The product 22 is placed on the base layer 50 on the first conveyor portion 64, which advances the base layer 50 and the product 22 in downstream direction 42 toward the second conveyor portion 66. As shown in FIG. 4, the cover layer 52 is secured to the base layer 50 and the product 22 is placed on the base layer 50, between the base layer 50 and the cover layer 52, at a location upstream of where the cover layer 52 is secured to the base layer 50. As the product 22 and the base layer 50 advance in the downstream direction 42 on the first conveyor portion 64, the stock material feed assembly 30 guides the cover layer 52 to extend over the product 22.

Figure 5:
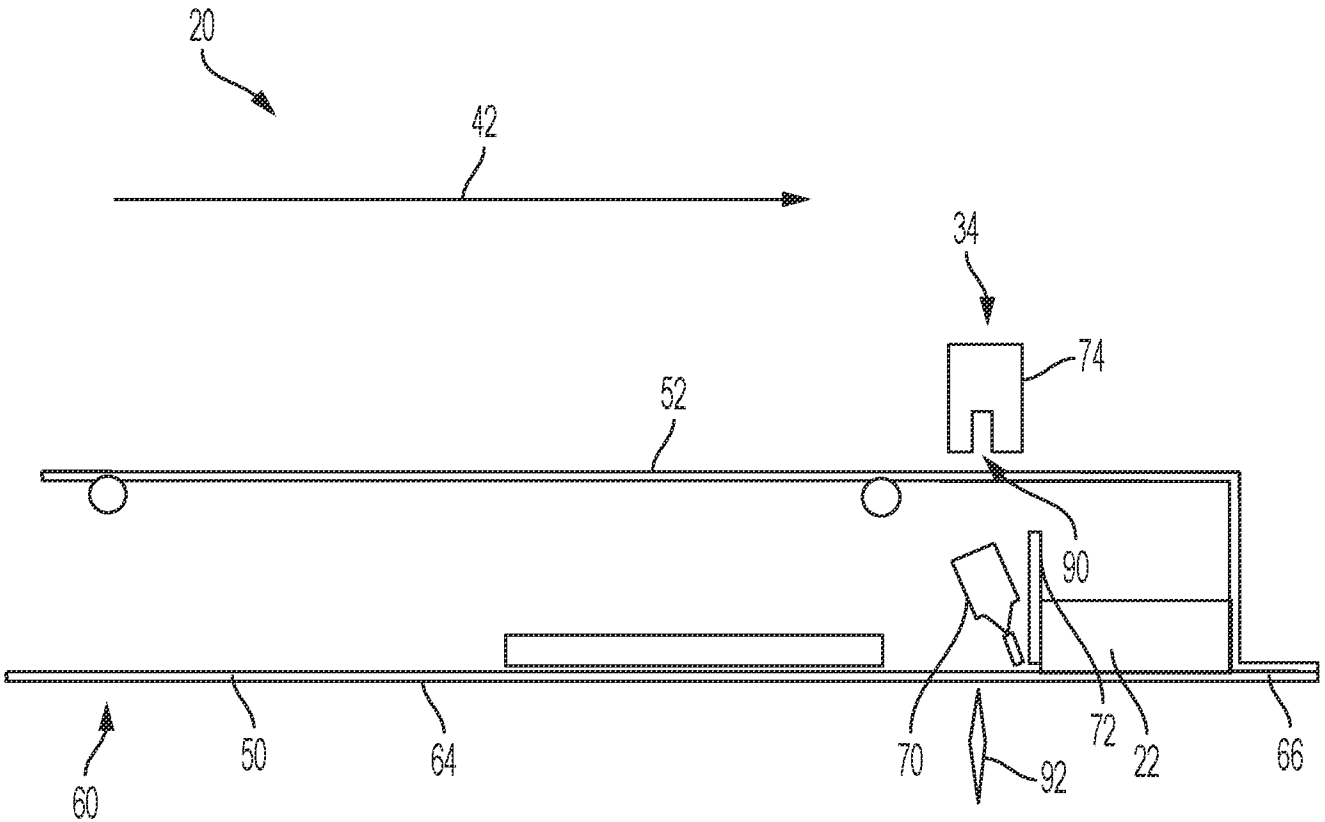

The cutting and securing assembly 34 includes an adhesive applicator 70 that deposits an adhesive, such as, but not limited to, liquid glue, hot glue, or an adhesive tape, onto the base layer 50 at a location adjacent an upstream end of the product 22, as shown in FIG. 5. In the illustrated embodiment the adhesive applicator 70 moves downstream until a locator 72 engages the upstream end of the product 22 and deposits adhesive on the base layer 50 adjacent to but upstream of the product 22. The locator 72 also can assist in advancing the product 22 in a downstream direction faster than the base layer 50, to push the product 22 up against the cover layer 52 where the cover layer is already secured to the base layer 50 downstream of the product 22. Alternatively, an electronic sensor may be provided to detect the upstream end of the product 22 and the system controller 40 can control the adhesive applicator 70 to apply adhesive after the upstream end of the product 22 passes the adhesive applicator 70.

Figure 6:
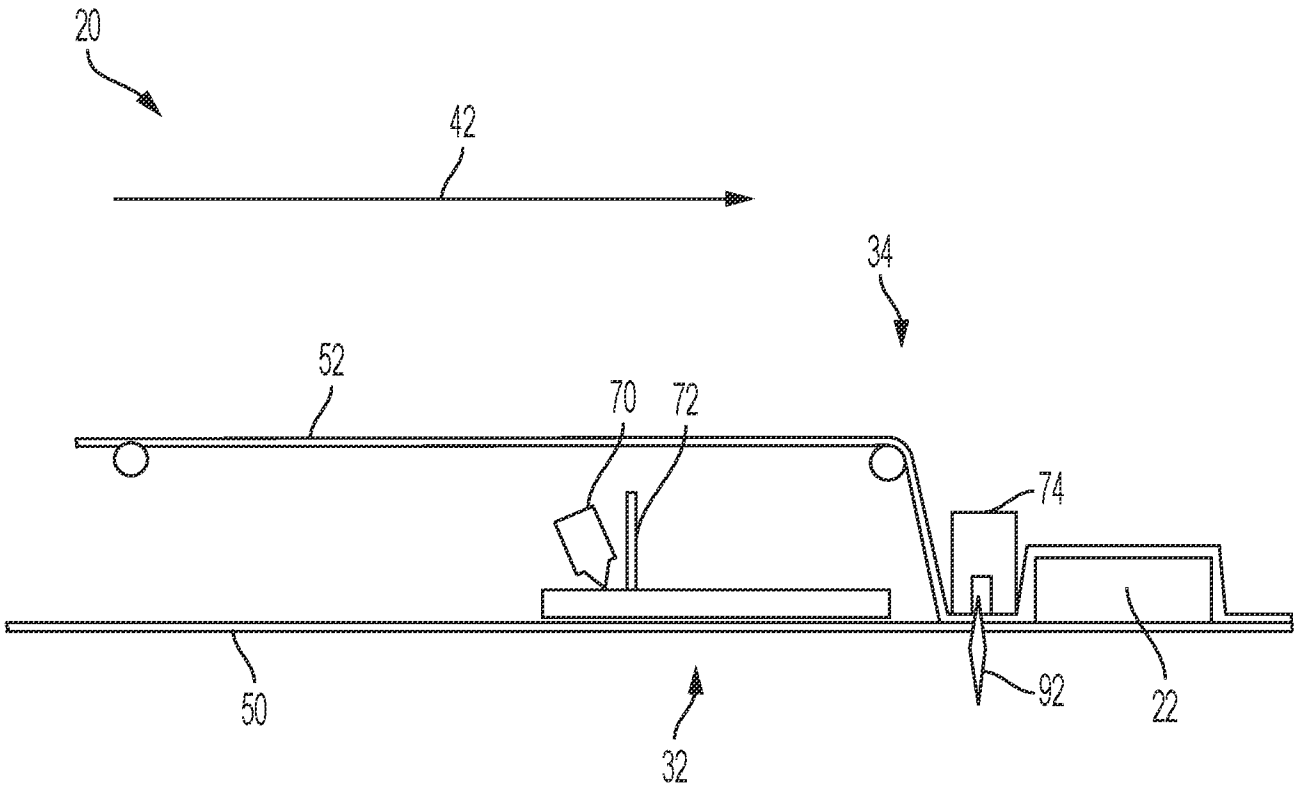

As shown in FIG. 6, the cutting and securing assembly 34 further includes a pressing element 74 and a cutting assembly 76. The pressing element moves vertically to press the cover layer 52 into engagement with the adhesive on the base layer 50 to capture the product 22 between the cover layer 52 and the base layer 50. The pressing element 74 also cooperates with the cutting assembly 76 to cut both the base layer 50 and the cover layer 52 to separate the captured product 22 from the continuous base layer 50 and continuous cover layer 52 extending from the supply 24. In the illustrated embodiment, the pressing element 74 is generally rectangular in shape with a recess 90 disposed on a bottom face of the pressing element 74. The pressing element 74 extends widthwise across the base layer 50 and is movable between a ready position (FIG. 6) vertically removed from the path of the cover layer 52 and the product 22 and a pressing position (FIG. 7) adjacent the base layer 50. The ready position generally is based on the height dimension of the largest product, which is predetermined and also determines the path of the cover layer 52.

As the product 22 advances in the downstream direction 42, the pressing element 74 engages the cover layer 52 and presses the cover layer 52 against the base layer 50 with the adhesive disposed below the pressing element 74 between the cover layer 52 and the base layer 50. As a result, the cover layer 52 is pressed against a top side of the product 22 and is secured to the base layer 50 at an upstream end of the product 22, capturing the product 22 between the cover layer 52 and the base layer 50. The cover layer 52 thus is secured to the base layer 50 both upstream and downstream of the product 22, and the product 22 is held to the base layer 50 by the cover layer 50.

The illustrated cutting assembly 76 cooperates with the pressing element 74 to cut the cover layer 52 and the base layer 50. The cutting assembly 76 includes a cutting element 92, such as a sharp wedge or a blade. The cutting element 92 is disposed underneath the gap between the first conveyor portion 64 and the second conveyor portion 66, and is movable between a ready position (FIG. 4) below a path of the base layer 50 and a cutting position (FIG. 6) where the cutting element 92 cuts the base layer 50 and the cover layer 52 and extends into the recess 90 in the pressing element 74. Both the base layer 50 and the cover layer 52 are cut at the same time during the same cutting step by the cutting element 92.

The cutting assembly 76 cuts both the base layer 50 and cover layer 52 along a cut line that is bounded on an upstream side and on a downstream side by the adhesive. A first portion of the adhesive is disposed upstream of the cut line and a second portion of the adhesive is disposed downstream of the cut line. Since a portion of the adhesive is disposed both upstream and downstream of the cut line, respective portions of the base layer 50 and the cover layer 52 are secured together on opposite sides of the cut line. Thus, when cutting the base layer 50 and the cover layer 52 on an upstream side of a product 22, the cutting assembly 76 is leaving the base layer 50 and the cover layer 52 secured together downstream of a subsequent product to be wrapped.

Figure 7:
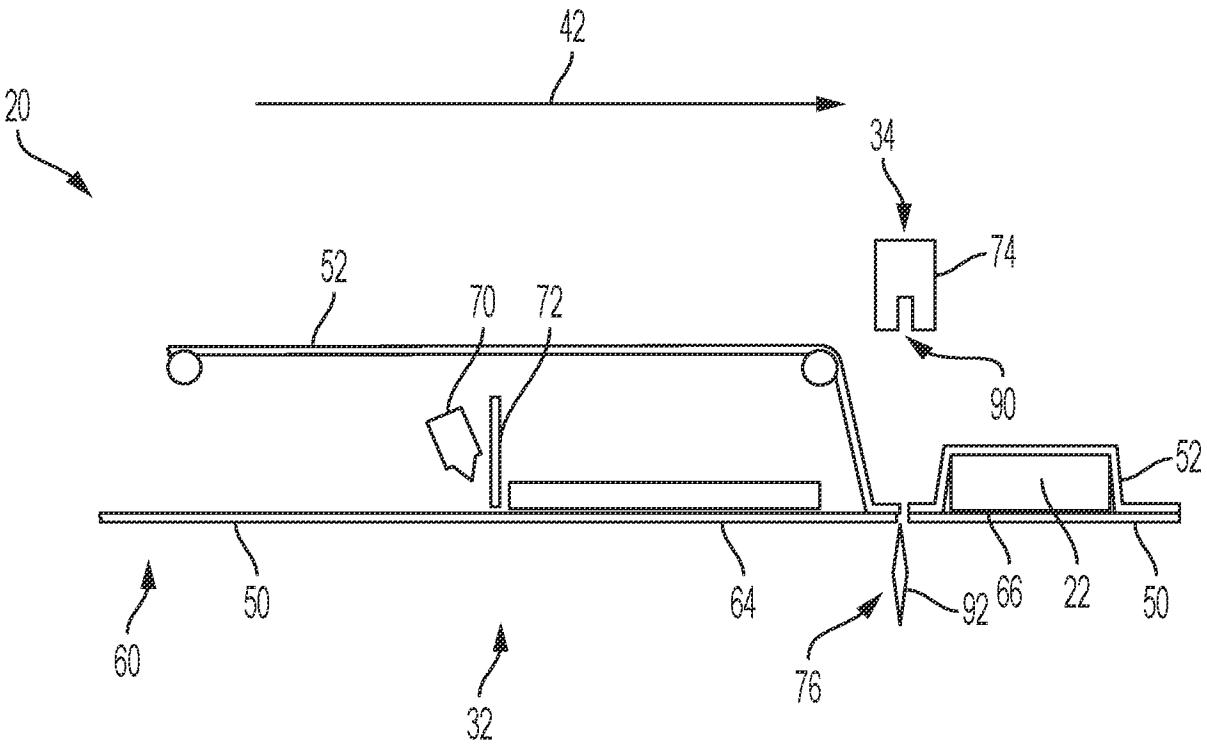

While the illustrated embodiment cuts the base layer 50 and the cover layer 52 at the same time, the pressing element 74 secures the cover layer 52 to the base layer 50 via the adhesive, as shown. Alternatively, the cutting assembly 76 may operate independently of the pressing element 74. Once the cover layer 52 is secured to the base layer 50 and both the base layer 50 and the cover layer 52 are cut, the pressing element 74 and the cutting element 92 return to their respective ready positions, as shown in FIG. 7.

After the base layer 50 and the cover layer 52 are cut, the product 22 continues to advance in the downstream direction 42 on the second conveyor portion 66 to the folding assembly 36. As shown in FIG. 2, the folding assembly 36 folds lateral portions of the base layer 50 widthwise over both the cover layer 52 and the product 22. First, lateral portions of the base layer 50 are folded upright at fold lines spaced approximately the width dimension W1 of the product 22, then a first side of the base layer 50 is folded over a top of the product 22. An adhesive is applied to the base layer 50, and a second side of the base layer 50 is folded over the top of the product 22 and secured to the first side of the base layer 50, completing the wrapping process. The folding assembly 36 also may include a mechanism for applying a shipping label or a printer for printing a label, and the wrapped product is ready for shipment.

Figure 8C:
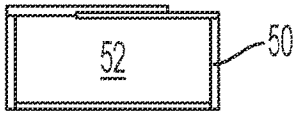
FIGS. 8A-10C are schematic illustrations of products of varying sizes (FIGS. 8A-8C, 9A-9C, and 10A-10C) placed on a base layer under a cover layer, including a top view (FIGS. 8A, 9A, and 10A), a side view (FIGS. 8B, 9B, and 10B), and a front view (FIGS. 8C, 9C, and 10C).
Figure 9C:
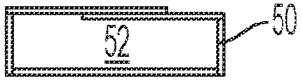
Figure 10C:
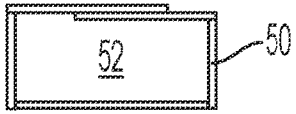
Figure 8B:
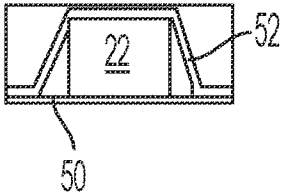
Figure 9B:
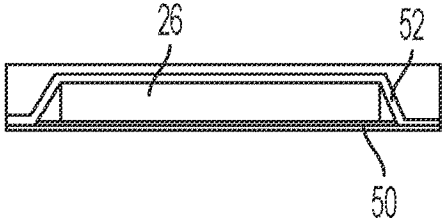
Figure 10B:
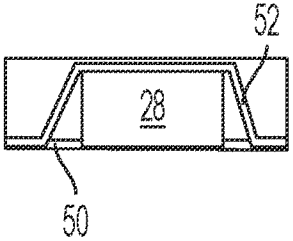
Figure 8A:
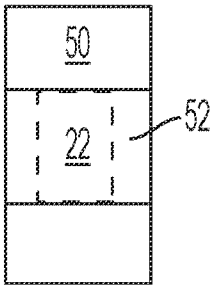
Figure 9A:
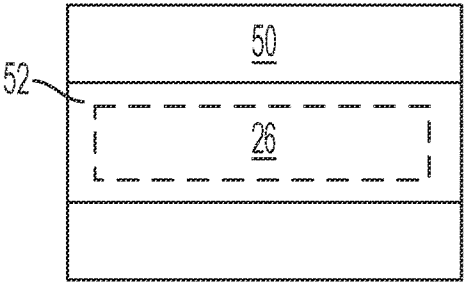
Figure 10A:
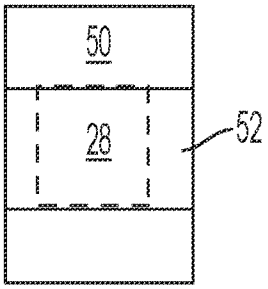

As mentioned above, an advantage of this packaging system 20 is that it adjusts to accommodate different product sizes and shapes. This is illustrated in FIGS. 8A-10C. Referring now to FIGS. 8A, 9A, and 10A, three different size products 22, 26, 28 are shown in a top view placed on the base layer 50 with the cover layer 52 overlying the product 22, 26, 28 and the base layer 50 and secured to the base layer 50 upstream and downstream of the product 22, 26, 28. In these examples, the base layer 50 and the cover layer 52 have the same width dimension and the products 22, 26, 28 being wrapped each have a different length dimension L and width dimension W1. A cross-sectional side view is shown in corresponding FIGS. 8B, 9B, and 10B showing how the cover layer 52 holds the products 22, 26, 28 with different length dimensions L and different height dimensions H to the base layer 50. FIGS. 8C, 9C, and 10C show front views of the wrapped products showing the different sizes that correspond closely to the width dimensions W1 and height dimensions H of each product 22, 26, 28.

A corresponding method for wrapping a product 22 for shipment will be described with reference to the packaging system 20 depicted in FIG. 1. Nevertheless, the method of packaging a product 22 for shipment can be accomplished using a product packaging system that is structurally different than the product packaging system depicted in FIG. 1.

The method for wrapping a product 22 for shipment includes advancing a base layer 50, such as from a pair of powered feed rollers 54 in a stock material feed assembly 30, in a downstream direction 42 on a product delivery assembly 32, such as a conveyor 60. The method includes placing at least one product 22 on the base layer 50 and advancing the product 22 in a downstream direction 42 on the base layer 50 on a first conveyor portion 64. The method includes identifying or detecting a length dimension L or an upstream end of the at least one product 22. The method includes applying an adhesive to the base layer 50 upstream of the product 22, such as with the adhesive applicator 70. The method further includes placing the cover layer 52 over the product 22 and the base layer 50, and after applying the adhesive to the base layer 50, pressing the cover layer 52 against the adhesive on the base layer 50 to secure the cover layer 52 and the product 22 to the base layer 52.

The method also includes cutting the base layer 50 and the cover layer 52 along a cut line with adhesive upstream and downstream of the cut line. The cutting step can occur at the same time as the pressing step. Alternatively, the pressing step may precede the cutting step. Finally, the method includes folding lateral portions of the base layer 50 widthwise around the product 22 and the cover layer 52, and securing the lateral portions together. The folding step may include folding a first lateral portion of the base layer 50 around the product 22, applying an adhesive, and then folding a second lateral portion of the base layer 50 around an opposite side of the product 22 and securing the second lateral portion to the first lateral portion. At this point, the product 22 is wrapped and ready for shipping.

An alternative embodiment of a packaging system 100 is shown in FIG. 11. In this packaging system 100, the base layer 50 and the cover layer 52 are cut to a desired length and the cover layer 52 is secured to the base layer 50. In other words, the cutting and securing assembly 34 is upstream of the product delivery assembly 32. The product delivery assembly 32 places the product 22 on top of both the cover layer 52 and the base layer 50. And the product scanner 62 previously described detects the product dimensions, which the system controller 40 uses to control the cutting assembly 76.

Then the folding assembly 36 folds upstream and downstream ends of the cover layer 52 around the product 22 lengthwise and secures the upstream and downstream ends of the cover layer 52 on top of the product 22. Then the folding assembly 36 folds lateral portions of the base layer 50 widthwise around the product 22 and the cover layer 52, similar to the folding assembly 36 in the preceding embodiment.

Figure 12:
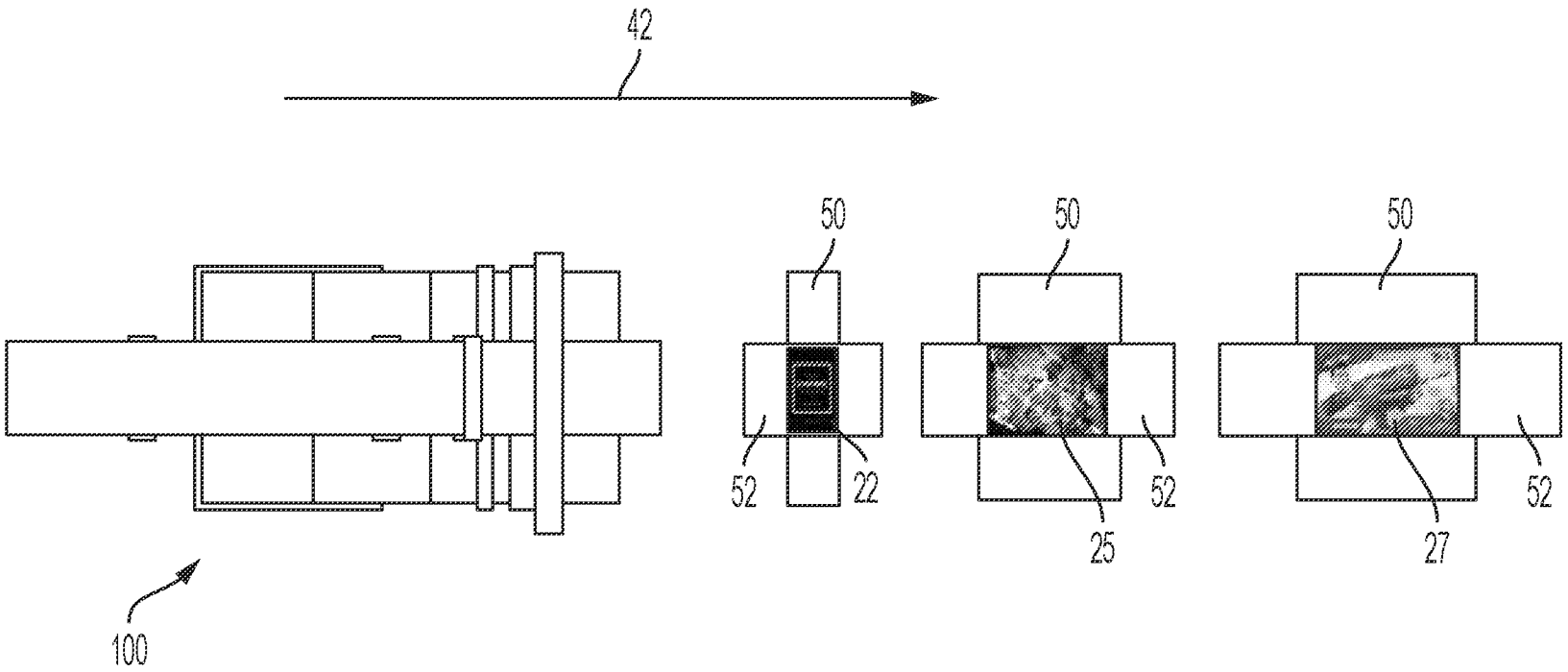
FIG. 12 is a schematic illustration of how the system of FIG. 11 accommodates different product sizes.

The manner in which this packaging system 100 accommodates different product sizes is illustrated in FIG. 12. The length of the base layer 50 and the cover layer 52 varies with the corresponding length dimension L of the product 22, 25, 27.

Thus, in summary the packaging method described herein for wrapping a product 22 for shipment includes advancing a base layer 50 in a downstream direction 42 and placing the product 22 for wrapping on the base layer 50. After the product 22 is placed on the base layer 50, depositing an adhesive is onto the base layer 50 at a location adjacent an upstream end of the product 22. A cover layer 52 is then extended over the top of the product 22 and the base layer 50. The method includes securing the cover layer 52 to the base layer 50, thereby securing the product 22 to the base layer 50 by securing the cover layer 52 to the base layer 50 both upstream and downstream of the product 22. The base layer 50 is then transversely folded widthwise over both the cover layer 52 and the product 22 to securely wrap the product 22 for shipment.

The invention claimed is:

1. A method for wrapping a product for shipment, the method comprising the following steps:

placing a product on a base layer;

extending a cover layer lengthwise on top of the product;

securing the cover layer to the base layer so that the product is secured to the base layer by the cover layer;

cutting the base layer and the cover layer after the securing step; and folding lateral portions of the base layer around the product widthwise and affixing the lateral portions of the base layer together after the securing step.

2. The method as claimed in claim 1, wherein the cutting step includes cutting both the base layer and the cover layer in the same cutting action.

3. The method as claimed in claim 1, wherein the cutting step includes cutting the base layer and the cover layer at a location upstream of the product.

4. The method as claimed in claim 1, wherein the securing step includes applying an adhesive to the base layer upstream of the product, and the cutting step includes cutting the base layer and the cover layer along a cut line, the cut line being disposed on the base layer with adhesive upstream and downstream of the cut line so that portions of the base layer and the cover layer are secured together on opposite sides of the cut line.

5. The method as claimed in claim 1, further comprising cutting the base layer and the cover layer at the same time the cover layer is secured to the base layer.

6. The method as claimed in claim 1, comprising the step of providing the base layer from a continuous sheet stock material and providing the cover layer from a continuous sheet stock material.

7. The method as claimed in claim 1, wherein the securing step includes applying an adhesive to the base layer and then pressing the cover layer against the adhesive on the base layer.

8. The method as claimed in claim 7, wherein the applying step includes identifying an upstream end of the product and applying the adhesive to the base layer at a location upstream of the product.

9. The method as claimed in claim 1, wherein the cutting step includes cutting the base layer and the cover layer upstream of the product.

10. The method as claimed in claim 1, further comprising detecting an upstream end of the product on the base layer.

11. The method as claimed in claim 10, wherein the detecting step includes detecting a length dimension of the product.

12. The method as claimed in claim 1, repeated for a sequence of products having at least one varying dimension.

13. A packaging system for wrapping a product for shipment, comprising:

a product delivery assembly configured to place a product on a base layer;

a sensor for detecting an upstream end of the product on the base layer;

an adhesive applicator configured to deposit an adhesive to the base layer at a location upstream of the product based on a signal from the sensor;

a stock material feed assembly configured to apply a cover layer on top of the product and the base layer;

a pressing element configured to press the cover layer to the base layer so that the adhesive secures the cover layer to the base layer in such a manner that the product is secured to the base layer by the cover layer;

a folding assembly downstream of the pressing element configured to fold lateral portions of the base layer widthwise around the product and the cover layer; and an adhesive applicator positioned to apply adhesive to the base layer to secure the folded lateral portions together.

14. The packaging system as claimed in claim 13, comprising a supply of sheet stock material for the base layer and the cover layer.

15. The packaging system as claimed in claim 13, comprising a cutting assembly configured to cut across a width dimension of the base layer and the cover layer.

16. The packaging system as claimed in claim 13, comprising a conveyor for advancing the base layer and the product placed on the base layer in a downstream direction past the pressing element.

17. A method for wrapping a product comprising:

supplying sheet stock material for a base layer and for a cover layer;

advancing the base layer and the cover layer in a downstream direction;

placing a product on the base layer;

extending a cover layer lengthwise over the product and the base layer;

securing the cover layer to the base layer upstream and downstream of the product so that the product is secured to the base layer by the cover layer;

cutting the cover layer and the base layer to separate the cover layer secured to the base layer from a sheet stock material supply;

transversely folding lateral portions of the base layer widthwise over the cover layer and the product;

securing the lateral portions of the base layer together over the cover layer and the product.

* * * * *